US006195800B1

(12) United States Patent
Gilmer et al.

(10) Patent No.: US 6,195,800 B1
(45) Date of Patent: Mar. 6, 2001

(54) BREATHABLE, WATERPROOF SWIM DIAPER AND METHOD OF MANUFACTURE

(75) Inventors: Patti C. Gilmer; Pamela Thomas; Reginold F. Cochran, all of Lula; Rodney D. Robinson, Gainesville, all of GA (US)

(73) Assignee: Future Products Corporation, Gainesville, GA (US)

( * ) Notice: Subject to any disclaimer, the term of this patent is extended or adjusted under 35 U.S.C. 154(b) by 0 days.

(21) Appl. No.: 08/923,159

(22) Filed: Sep. 4, 1997

(51) Int. Cl.[7] ..... A41D 5/00; A41D 7/00
(52) U.S. Cl. ..... 2/67; 2/238
(58) Field of Search ..... 604/367; 2/238, 2/67, 404, 407

(56) References Cited

U.S. PATENT DOCUMENTS

| | | | | |
|---|---|---|---|---|
| D. 377,980 | * | 2/1997 | Slingland | D24/126 |
| 3,717,150 | | 2/1973 | Schwartz | 128/284 |
| 4,272,848 | * | 6/1981 | Hoofnagle | 2/69 |
| 4,585,447 | | 4/1986 | Karami | 604/385 A |
| 4,630,320 | | 12/1986 | Van Gompel | 2/406 |
| 4,643,728 | | 2/1987 | Karami | 604/385 A |
| 4,747,846 | * | 5/1988 | Boland et al. | 604/396 |
| 5,114,419 | * | 5/1992 | Daniel et al. | 604/385.1 |
| 5,406,646 | * | 4/1995 | Balit et al. | 2/67 |
| 5,451,217 | * | 9/1995 | Fujioke et al. | 604/385.1 |
| 5,489,282 | * | 2/1996 | Zehner et al. | 604/385.1 |
| 5,502,842 | | 4/1996 | Wagner | 2/67 |
| 5,527,302 | * | 6/1996 | Endres et al. | 604/385.1 |
| 5,545,158 | | 8/1996 | Jessup | 604/385.2 |
| 5,561,858 | | 10/1996 | Poirier | 2/67 |
| 5,790,983 | * | 8/1998 | Rosch et al. | 2/69 |
| 5,837,352 | * | 11/1998 | English et al. | 604/367 |

FOREIGN PATENT DOCUMENTS

1133404 * 11/1968 (GB) .

OTHER PUBLICATIONS

Product literature on DuPont polyester elastomer products *Sontara* and *Hytrel*.
Product literature on *Bertek* flexible polyurethane foam.

* cited by examiner

*Primary Examiner*—John G. Weiss
*Assistant Examiner*—Michael Bogart
(74) *Attorney, Agent, or Firm*—Troutman Sanders LLP; Kenneth Southall

(57) ABSTRACT

A swim diaper for use by a child while swimming, bathing or otherwise exposed to an aqueous environment includes a main torso section formed from a sheet of breathable, waterproof material of sufficient thickness to retain solid waste and having a moisture vapor transmission rate of at least 200 g/m$^2$/day. The main torso section has a torso receiving aperture at the upper end of the main torso section for receiving a torso and leg receiving apertures located in the lower portion of the main torso section for receiving a child's legs.

11 Claims, 1 Drawing Sheet

BREATHABLE, WATERPROOF SWIM DIAPER AND METHOD OF MANUFACTURE

BACKGROUND OF THE INVENTION

1. Technical Field

This invention relates generally to a diaper product for infants and small children to wear during water activities. Particularly, this invention relates to a breathable, waterproof swim diaper which will retain solid waste but will not absorb liquids from the wearer or surrounding environment.

2. Description of the Prior Art

In recent decades, highly absorbent disposable diapers have replaced reusable cotton diapers as the diaper of choice for use by most parents. This is in large part due to the fact that disposable diapers are generally much more absorbent than cloth diapers, are easier to use, and may be conveniently discarded when soiled. However, neither reusable cloth diapers nor conventional disposable diapers are well adapted for use by infants or small children while swimming or participating in other water activities.

When used during water activities, highly absorbent disposable diapers and thick reusable cloth diapers become bulky and can pose a potential drowning hazard to infants and small children. Since these standard diapers are designed to absorb large quantities of water, they may become quite heavy while a child is swimming hindering the child's ability to stay afloat. These diapers may also become a falling hazard for toddlers once they have left the water.

In addition to posing potential safety hazards, conventional absorbent disposable diapers become uncomfortable when saturated with water, and may fall off of a child due to the increased saturated diaper weight. This creates a need for parents to frequently change the diapers of children who are swimming or bathing, resulting in both significant inconvenience and use of a large number of diapers.

Also, many disposable diapers are constructed of fibrous materials which may quickly disintegrate in water. Failure of these diapers can result in the introduction of fibrous material and fecal solid waste into the pool water, creating both a possible health hazard for other users and an unsightly and unpleasant swimming environment. Loose fibrous material may also potentially clog pool filtration and cleaning equipment, leading to increased pool cleaning and maintenance costs.

One approach to providing a diaper for use by swimming infants would be to combine a water-tight seal around the diaper openings in conjunction with an outer waterproof layer to prevent the absorbent portion of the diaper from coming into contact with water in the surrounding environment. Many conventional diapers have used elastic in an attempt to create a water-tight seal between the diaper and the wearer along the leg and body openings of the diaper.

U.S. Pat. Nos. 4,585,447 and 4,643,728 disclose disposable diapers having an absorbent layer encased within two hydrophobic outer sheets and the use of elastic crotch and waist seals to prevent leakage of liquid waste from the diapers. However, it is difficult to use elastic to maintain a seal sufficiently tight between a diaper and the skin of a small child to prevent the absorbent material from coming into contact with the water without unacceptably constricting the torso and extremities of the child. Excess constriction may interfere with the child's comfort and mobility, and potentially may cause circulation problems in the extremities of the child.

Another approach to the problem is to encase the diaper in a waterproof material and create a water-tight seal to protect a diaper from the water while a child is swimming. For example, U.S. Pat. No. 5,502,842 discloses a waterproof protective swimwear garment designed to be worn over a conventional diaper. The invention uses inflatable chambers at the torso and leg openings of the garment to produce a water-tight seal and prevent the underlying diaper from coming into contact with the water. Unfortunately, this approach requires the presence of buoyant air-filled chambers at the child's abdomen and legs, shifting the child's center of buoyancy lower within the body and thereby making it difficult for a child to maintain his or her head above the surface of the water. Additionally, use of a waterproof material prevents escape of sweat and may lead to development of a rash or chafing of the areas of skin enclosed by the garment.

In light of the above disadvantages of prior diaper products, it would clearly be advantageous to provide a diaper designed specifically for use by swimming infants which does not pose a safety risk when saturated, is comfortable when wet, and does not need to be frequently changed when exposed to water.

It is therefore an object of the present invention to provide a new and improved diaper to retain potentially hazardous solid waste, which will not become bulky or heavy through absorption of large quantities of liquid when a child is swimming, bathing or otherwise immersed in an aqueous environment.

It is another object of the present invention to provide a new and improved diaper product which may comfortably be worn under the outer swimwear of a swimming or bathing child and will remain comfortable even following immersion in water.

It is another object of the present invention to provide a new and improved diaper product which is waterproof and breathable and will thus remain comfortable even following immersion in water.

It is yet another object of the present invention to provide a new and improved diaper which will neither disintegrate nor fall off of a child following immersion in water and thus does not need to be frequently changed while a child is bathing or otherwise exposed to an aqueous environment.

SUMMARY OF THE INVENTION

The above objectives are accomplished according to the present invention by providing a swim diaper for use by a child while swimming, bathing or otherwise exposed to an aqueous environment. The swim diaper includes a main torso section formed from a sheet of breathable, waterproof material of sufficient thickness to retain solid waste and having a moisture vapor transmission rate of at least 200 $g/m^2/day$. This main torso section has a torso receiving aperture at the upper end of said main torso section for receiving a torso and leg receiving apertures located in the lower portion of said main torso section for receiving a child's legs.

BRIEF DESCRIPTION OF THE DRAWINGS

The construction designed to carry out the invention will hereinafter be described together with other features thereof. The invention will be more readily understood from a reading of the following specification and by reference to the accompanying drawings forming a part thereof, wherein an example of the invention is shown.

DETAILED DESCRIPTION OF PREFERRED EMBODIMENT

Figure 1:
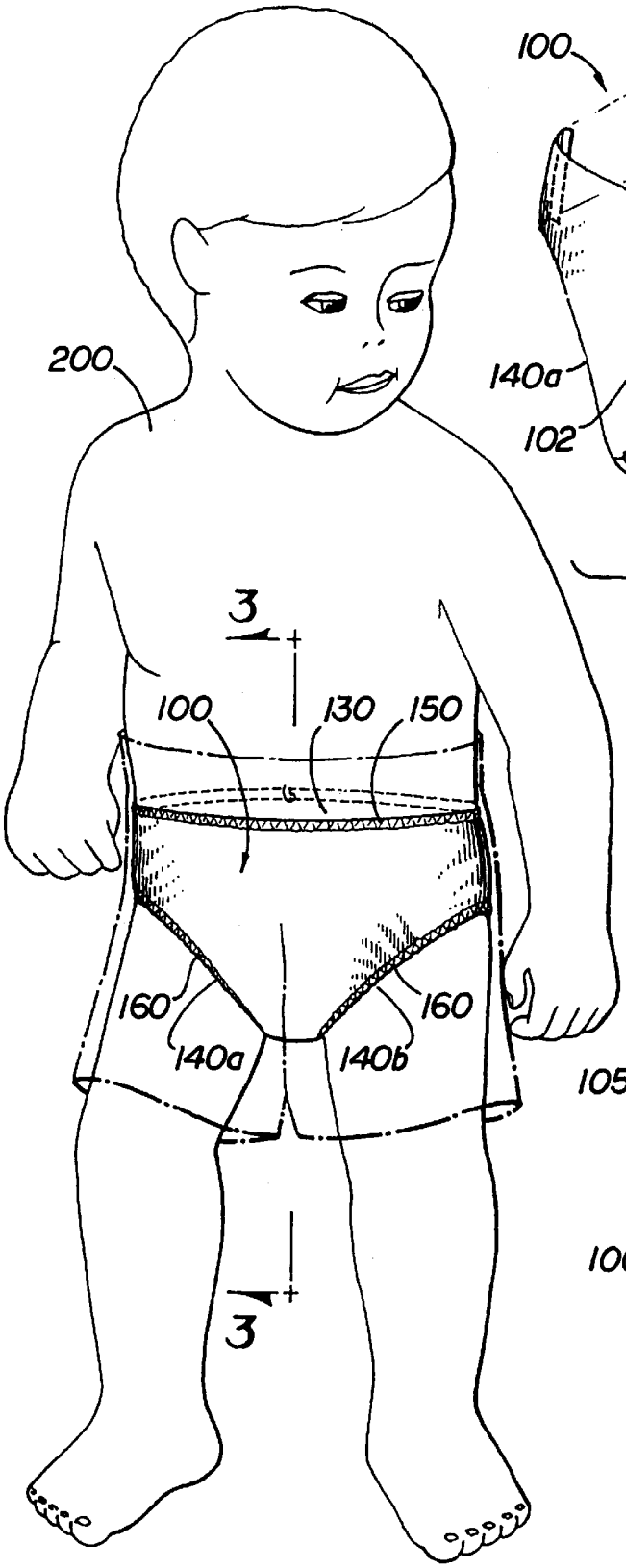
FIG. 1 is diagram illustrating a child wearing a swim diaper, according to the present invention, under a swimsuit.

Referring now in more detail to the drawings, the invention will now be described in more detail. Referring to FIG. 1, the swim diaper 100 may be worn by a child 200 while swimming or otherwise immersed in an aqueous environment, such as while bathing or playing with a hose or lawn sprinkler.

Figure 2:
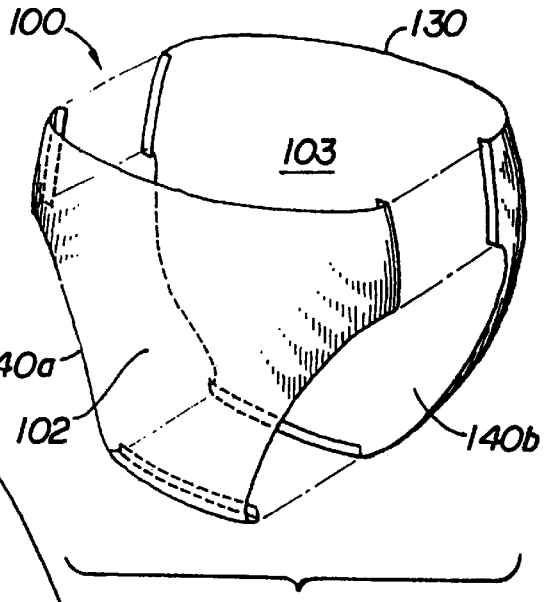
FIG. 2 is an exploded perspective view illustrating the structure of the swim diaper according to the present invention.
Figure 3:
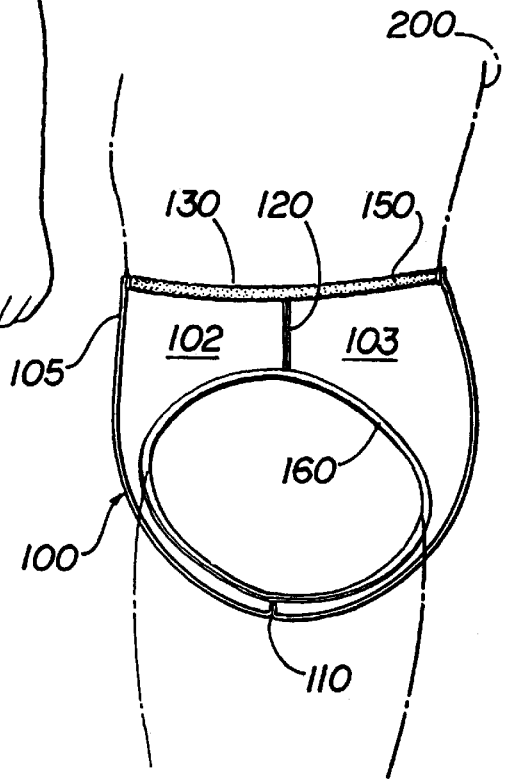
FIG. 3 is a cross-section taken along lines 3—3 in FIG. 1 illustrating the structure of the swim diaper according to the present invention.

Referring now to FIG. 2 and FIG. 3, swim diaper 100 may be made from a relatively inexpensive fabric and is thus disposable, although a more sturdy fabric may be used to construct a reusable swim diaper. The fabric is thin enough to be worn comfortably under a child's outer swimwear while at the same time having sufficient structural integrity to contain solid waste. The swim diaper 100 is waterproof and substantially non-absorbent to minimize absorption of liquid waste or liquids from the surrounding environment. Because the fabric is waterproof, no appreciable weight is added by the absorption of bodily fluids or water from the surrounding environment, as would occur with cotton diapers or standard disposable diapers. Furthermore, the swim diaper 100 is breathable to enhance the comfort of the wearer.

In the preferred embodiment, the swim diaper 100 is constructed from a medical grade, waterproof, breathable laminate such as Bertek Medifilm 330®. Bertek Medifilm 330® is a waterproof laminate consisting of a thin layer of DuPont Hytrel® polyester film coating disposed on a supporting layer of DuPont Sontara® which is a non-woven, spun laced polyester fabric. Bertek Medifilm 330® is breathable, having a moisture vapor transmission rate of approximately 500 to 570 $g/m^2$/day.

For the comfort of the child it is important that the laminate be waterproof, substantially non-absorbent, and breathable, with a moisture vapor transmission rate of at least 200 $g/m^2$/day. The necessary moisture vapor transmission rate will, however, vary depending upon the nature of the non-woven supporting material and preferably should be below approximately 2000 $g/m^2$/day. Of course, one of ordinary skill in the art will recognize that the swim diaper of the present invention may also be constructed of other suitable breathable, waterproof materials with sufficient strength. Examples of alternative materials include treated polyester, acrylic, nylon, or polypropylene fabrics and laminates.

In the preferred embodiment, swim diaper 100 consists of a sheet of laminate with a thickness of approximately 1–3 mm cut to form a standard symmetrical pattern for underwear having a front main section 102 and a rear main section 103. When sewn at the crotch 110 and hips 120, these two sections form an main torso section 105 of an undergarment having a waist receiving opening 130 and two leg receiving openings 140*a* and 140*b*. An elastic waist band 150 and elastic leg bands 160 may be sewn into these openings to ensure a snug yet comfortable fit.

The front and rear main sections of the swim diaper 102 and 103 may be joined at the crotch 110 and hip 120 seams by being either sewn, secured with adhesive or by heating the foam under pressure to cause the plastic to bond by thermoplastic lamination. Of course, it will be clear to one of ordinary skill in the art that any of a number of standard undergarment sewing patterns may be used to construct the swim diaper 100 and that the seams may be joined by any equivalent method.

The swim diaper 100 may be used by first garbing the child and ensuring that there is a snug fit of the elastic waist band and elastic leg bands. The child may then be allowed to swim, bathe, play in a sprinkler or perform any other water activities. Any solid or semi-solid waste emissions will be contained by the diaper. When the child has completed his exposure to the aqueous environment the diaper may be removed and either discarded or washed and reused.

In order to demonstrate the advantages of the swim diaper 100 over conventional absorbent diapers, a number of tests were conducted. The results of these tests are provided in the table below. The samples tested include a variety of styles of diapers currently available to the consumer and both disposable and reusable swim diapers representing two embodiments of the present invention. The identity of the samples tested is listed below:

A. Disposable Swim Diaper
B. Reusable Swim Diaper
C. Brand "A" disposable diaper
D. Brand "B" disposable diaper
E. Brand "C"
F. Brand "D"
G. Brand "E"
H. Brand "F"
I. Brand "G"

The above samples were subjected to an absorbency test to determine the amount of fluid which would be absorbed. Each sample was initially weighed in the dry state on a chatillon spring balance scale graduated in ⅛ oz. increments. After the weight of each sample was recorded, the samples were submerged in an enclosed cage within a tank of fresh water (82° F., 63% ambient relative humidity) for a period of 10 minutes. The test results for the samples were as follows.

| Sample | Dry Weight | Wet Weight | Absorbency |
|---|---|---|---|
| A | 1 oz. | 2 oz. | 1 oz. |
| B | 1 oz. | 4 oz. | 3 oz. |
| C | 3 oz. | 3 lb. 0 oz. | 2 lb. 13 oz. |
| D | 2 oz. | 3 lb. 7 oz. | 3 lb. 5 oz. |
| E | 2 oz. | 3 lb. 8 oz. | 3 lb. 6 oz. |
| F | 3 oz. | 1 lb. 2 oz. | 15 oz. |
| G | 2 oz. | 2 lb. 12 oz. | 2 lb. 10 oz. |
| H | 5 oz. | 1 lb. 1 oz. | 12 oz. |
| I | 2 oz. | 3 lb. 8 oz. | 3 lb. 6 oz. |

Samples C, D, E, G and I all became extremely heavy after absorbing their full capacity of water, and therefore would most likely fall off of a child and contribute to the potential safety problems associated with loose fecal matter in a swimming or bathing environment. Furthermore, if these products were used in a pool or other aquatic environment without the use of other flotation means, such as inflatable arm bands or swimming aids, the child could experience difficulty in the water, thus contributing to a potential risk of drowning. While, samples F and H display a lesser degree of absorbency, they may still likewise pose some risk to a swimming child.

By contrast, samples A and B, representing the disposable and reusable embodiments of the present invention, absorb only 1 and 3 oz. of water respectively. Since the absorbency of these samples is only a fraction of that seen in the other samples, the hazards resulting from absorption would likewise be much smaller.

What have been described above are preferred embodiments of the present invention. It is, of course, not possible to describe every conceivable combination of methodologies for purposes of describing the present invention. However, one of ordinary skill in the art will recognize that many further combinations, permutations and modifications of the present invention are possible. Therefore, all such possible combinations, permutations and modifications are to be included within the scope of the claimed invention, as defined by the claims below.

What is claimed is:

1. A single-layer swim diaper for use by a child when swimming, bathing or otherwise exposed to an aqueous environment, said diaper consisting essentially of:

a main torso section formed from a laminate, said laminate comprising a film of breathable, waterproof material bonded onto a substrate of non-woven, substantially non-absorbent fabric having a thickness sufficient to retain solid waste, wherein said laminate has a thickness in the range of one millimeter to three millimeters, and a moisture vapor transmission rate of at least 200 $g/m^2/day$;

said main torso section having a torso receiving aperture at the upper end of said main torso section for receiving a torso, said torso receiving aperture including an elastic band to ensure a snug fit about said torso; and said main torso section having leg receiving apertures located in the lower portion of said main torso section for receiving legs, each of said leg receiving aperture including an elastic band to ensure a snug fit about a respective leg.

2. The swim diaper of claim 1, wherein said laminate has a moisture vapor transmission rate of less than 2000 $g/m^2/day$.

3. The swim diaper of claim 1, wherein said laminate has a moisture vapor transmission rate in the range of 500 to 570 $g/m^2/day$.

4. The swim diaper of claim 1, further comprising elastic bands carried by the periphery of said torso and leg receiving apertures for ensuring a snug fit, thereby restricting the passage of bacteria into the aqueous environment.

5. The swim diaper of claim 1, wherein said substrate includes a spun laced polyester.

6. The swim diaper of claim 5, wherein said substrate is generally 1–3 mm thick.

7. The swim diaper of claim 1, wherein said main torso section further comprises two sheets of laminate joined at the crotch and hips to form a standard underwear pattern.

8. The swim diaper of claim 7, wherein said sheets of laminate are joined by stitches.

9. The swim diaper of claim 1, wherein said swim diaper will retain less than three (3) ounces of water following complete immersion in water for a period of 10 minutes.

10. The swim diaper of claim 1, wherein said swim diaper will retain less than one (1) ounce of water following complete immersion in water for a period of 10 minutes.

11. A breathable, waterproof, single layer swim diaper for use to retain solid or semi-solid waste excreted by swimming children, said swim diaper consisting essentially of:

a main torso section formed from a laminate, said laminate comprising a film of breathable, waterproof material bonded onto a substrate of non-woven, substantially non-absorbent fabric having a thickness sufficient to retain solid waste;

said main torso section having a torso receiving aperture located at the upper end of said main torso section;

said main torso section having leg receiving apertures located in the lower portion of said main torso section; and elastic bands carried by the periphery of said torso and leg receiving apertures to ensure that said apertures snugly fit the legs and torso of the wearer.

* * * * *